United States Patent [19]

Sagedahl et al.

[11] Patent Number: 4,592,545

[45] Date of Patent: Jun. 3, 1986

[54] ISOKINETIC EXERCISE APPARATUS AND METHOD

[76] Inventors: Steven M. Sagedahl, 750 Boone Ave. N., Golden Valley, Minn. 55427; Jeffry W. German, 6624 Stevens Ave. S., Richfield, Minn. 55423; Robert M. Wolfe, 710 - 13th Ave. SE., Minneapolis, Minn. 55414

[21] Appl. No.: 649,435

[22] Filed: Sep. 11, 1984

Related U.S. Application Data

[63] Continuation-in-part of Ser. No. 575,209, Jan. 30, 1984.

[51] Int. Cl.[4] ..... A63B 21/00

[52] U.S. Cl. ..... 272/125; 272/136; 273/191 R; 273/88

[58] Field of Search ..... 272/125, 136, 117; 273/191 R, 191 A, 166

[56] References Cited

U.S. PATENT DOCUMENTS

| | | | |
|---|---|---|---|
| 2,134,451 | 10/1938 | Mogren | 272/117 |
| 3,462,156 | 8/1969 | Gentry . | |
| 3,465,592 | 9/1969 | Perrine | 272/130 |
| 3,567,219 | 3/1971 | Foster . | |
| 3,738,661 | 6/1973 | Moller | 273/191 R |
| 3,784,194 | 1/1974 | Perrine | 272/92 C |
| 4,211,418 | 7/1980 | Oppenheimer | 273/186 R |
| 4,328,964 | 5/1982 | Walls | 272/136 |
| 4,337,050 | 6/1982 | Engalitcheff | 434/260 |
| 4,355,633 | 10/1982 | Heilbrun | 272/125 |

OTHER PUBLICATIONS

"Isolated-Joint Testing & Exercise . . . , a Handbook for Using Cybex ® II and the U.B.X.T. TM ", Cybex, 2100 Smithtown Avenue, Ronkonkoma, New York, 11779, 1981.

*Primary Examiner*—Richard J. Apley
*Assistant Examiner*—James Prizant
*Attorney, Agent, or Firm*—Merchant, Gould, Smith, Edell, Welter & Schmidt

[57] ABSTRACT

The present invention is directed to an exercising apparatus (20) which includes a torque arm (24) for rotation on a shaft (38) which is connected to a countertorque machine (26). The exercising person moves torque arm (24) through a flexible strap (28). Strap (28) includes a loop (36) for sliding along torque arm (24). The flexibility and sliding capability of strap (28) provide for the person to do the exact movement which he would otherwise do during an athletic event. Therefore, the person may exercise good form and coordination at the threshold speed of the resistance machine (26) for the movement of a particular sport.

8 Claims, 25 Drawing Figures

FIG. 4
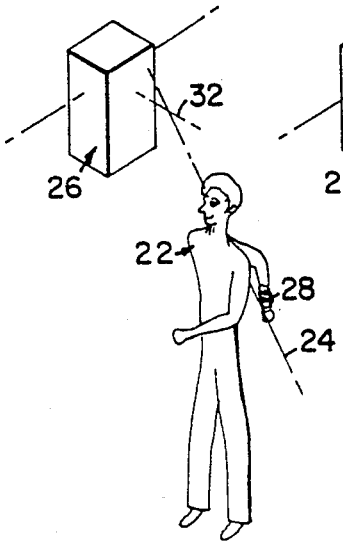
FIG. 5
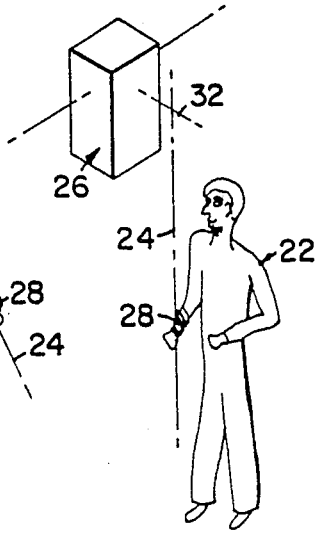
FIG. 6
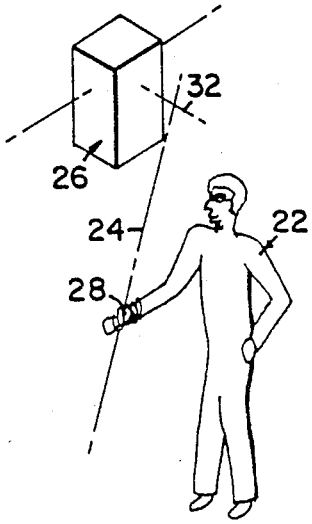
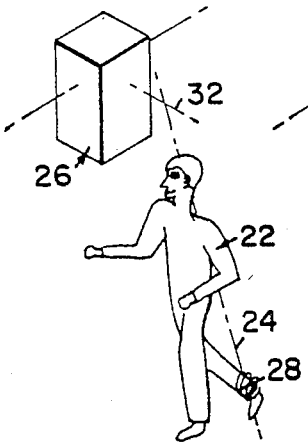
FIG. 7
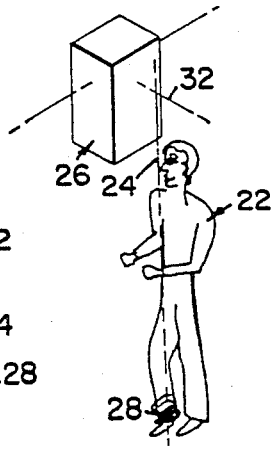
FIG. 8
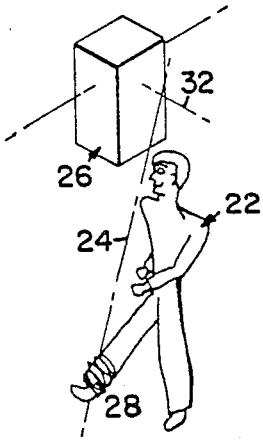
FIG. 9

FIG. 14
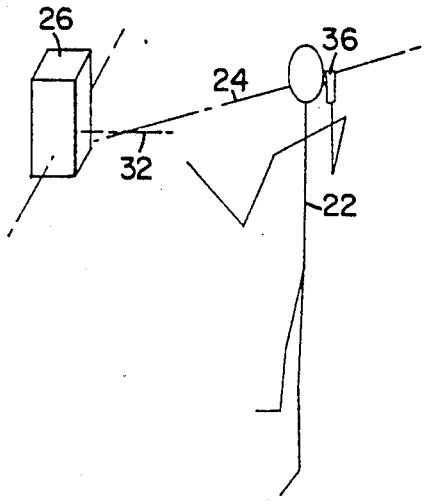
FIG. 15
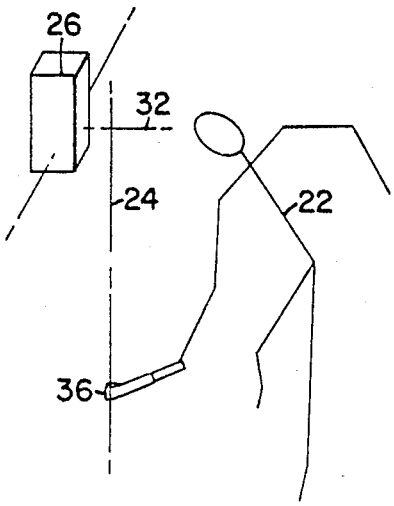
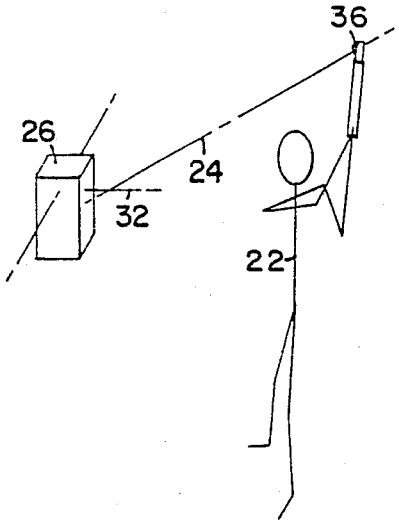
FIG. 16
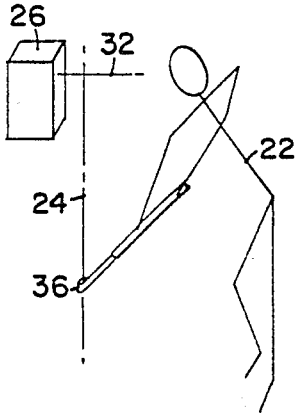
FIG. 17

FIG. 19
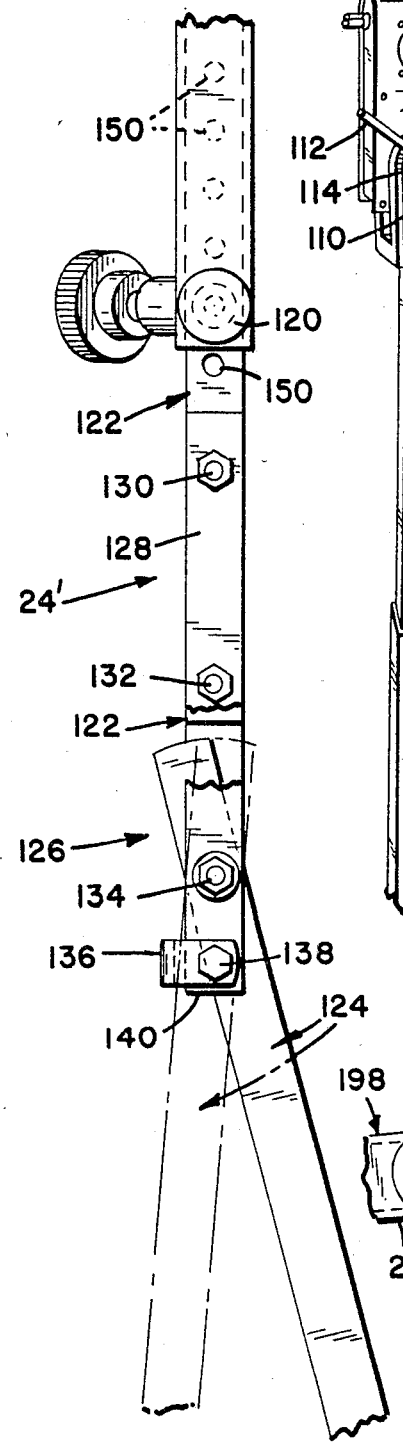
FIG. 18
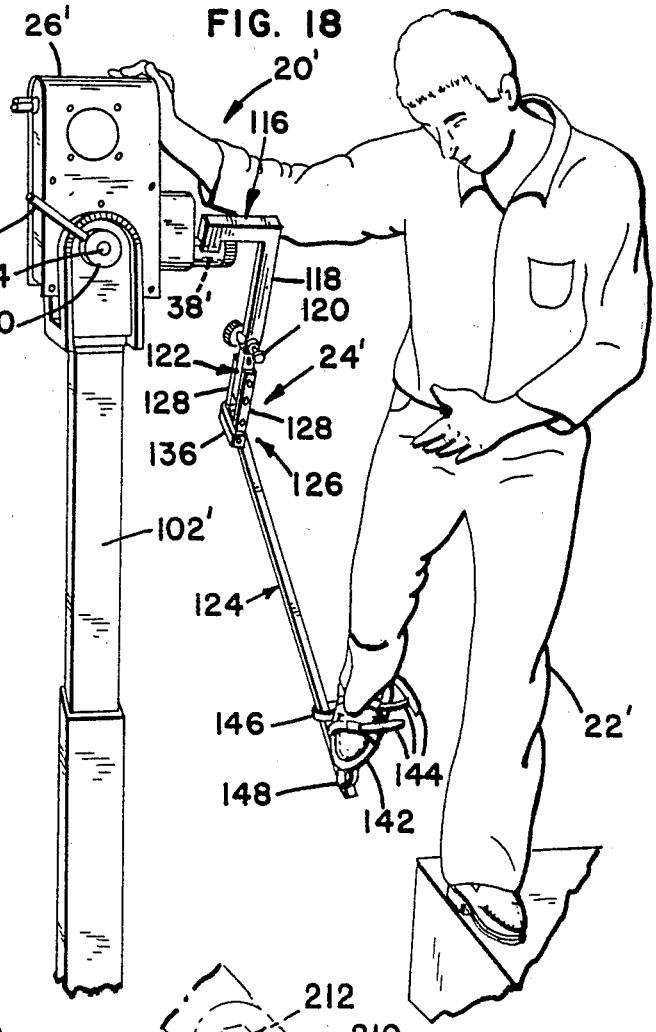
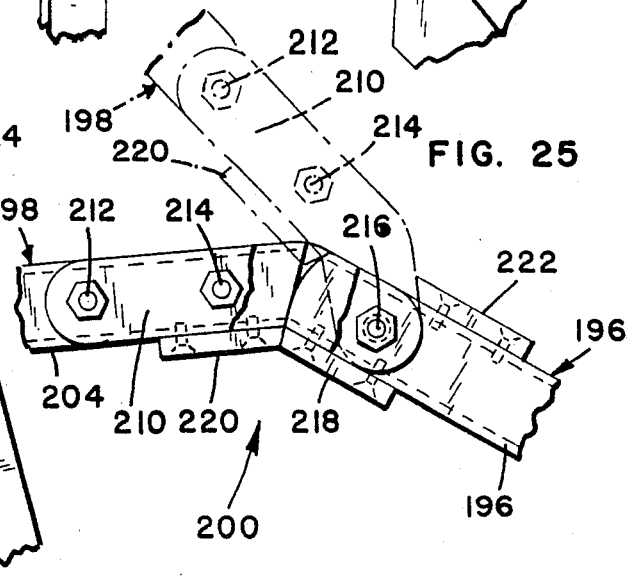
FIG. 25

ISOKINETIC EXERCISE APPARATUS AND METHOD

This is a continuation-in-part application of Ser. No. 575,209, filed Jan. 30, 1984.

FIELD OF THE INVENTION

The present invention is directed to an exercise apparatus and method and, more particularly, to an apparatus which allows a person to stress muscles while doing the specific movements applicable to a specific sport.

BACKGROUND OF THE INVENTION

Actual muscle strength potential varies as the muscle lengthens or shortens. With this in mind, muscle exercise may be characterized as follows:

(I) Passive exercise wherein the subject does not exert the muscular force producing the exercise motion.

(II) Active exercise wherein the subject exerts the muscular force producing the exercise muscle movement.

(A) Categorized by direction of motion.

(1) Concentric contraction wherein the muscle shortens while the subject is contracting against external resistance.

(2) Eccentric contraction wherein the muscle lengthens while the subject is contracting against external resistance.

(B) Categorized by response to muscle output.

(1) Isotonic contraction or exercise wherein the speed of the exercise motion varies in response to the magnitude of the muscular force.

(a) Constant resistance - concentric and eccentric contraction wherein the resistance is constant throughout the range of motion.

(b) Variable resistance - concentric and eccentric contraction wherein the resistance is varied throughout the range of motion to a general strength curve for that movement.

(2) Accommodating contraction or exercise wherein the resistance varies to equal to the exercising individual's voluntary force output.

(a) Isometric contraction or exercise wherein the length of the muscle is held constant during a static contraction, so that the external assistance force varies in response to the magnitude of the muscle force.

(b) Isokinetic contraction or exercise (concentric or eccentric) wherein the speed of the exercise motion is held constant during a dynamic movement, so that the external resistance force varies in response to the magnitude of the muscle force.

(i) a one directional resistance with two and/or three dimensional movements (ii) a two directional resistance applied at a fixed radius about a fixed axis of rotation.

It is well known that the overall conditioning of an athlete is very important. For this reason, many athletes lift weights, run, stretch and generally play a variety of sports to remain in good condition. Additionally, numerous practice sessions are conducted wherein the specific movements important to the athlete during his particular athletic contest are practiced over and over again many times a week. For example, in baseball a hitter may take batting practice for a period of time each day. Similarly, a football kicker will simply kick a ball many times each day. Or, a hockey player will practice numerous slap shots day after day. Such practicing improves coordination and timing but another important aspect of the practice is the strengthening of the specific muscles which are used during the specific movement.

In a rehabilitation sense, U.S. Pat. No. 4,337,050 shows a recognition of the importance of isolating joint-type exercise movements for rehabilitating a specific muscle. The apparatus disclosed provides resistance about a fixed but adjustable rotating axis with an adjustable but fixed radius. This fixed radius does not allow for the elliptical type of two and/or three dimentional movements involved with training movements specific to athletic sports.

U.S. Pat. No. 3,567,219 shows an earlier version of similar apparatus. It provides for exercising by pushing or pulling an arm about a fixed axis.

With respect to sports, U.S. Pat. No. 2,134,451 shows the use of a baseball bat or a tennis racket attached to a weight hanging from a pulley system. Muscles are exercised to the extent that movement of the bat or racket in one direction requires a force equivalent to lifting the weight. U.S. Pat. No. 3,462,156 shows a similar idea for a golf club wherein the handle is connected with a cord to a retraction reel. U.S. Pat. No. 4,328,964 provides a more recent version of the same concept in that elastic ropes are fixed at one end and connected to various athletic instruments at the other end. Movement in one direction away from the fixed end of the ropes is resisted.

The devices of this latter group of patents provide a resisting stress for some of the muscles used during a particular athletic movement, but the design of the devices prevents the type of movement which would really be used during an athletic event and, furthermore, the devices provide resistance only in one direction while practicing any type of movement.

U.S. Pat. No. 3,738,661 discloses a golf exercising device which allows the exercising person to swing at an adjustable but fixed radius about an adjustable but fixed axis of rotation. Although many of the muscles used during a golf swing are exercised by this machine, the form of the swing is dictated.

U.S. Pat. No. 4,211,418 shows a different approach wherein an apparatus has a pair of rods at approximately 90 degrees with respect to each other. A rotational axis bisects the angle between the rods. The exercising person places a golf club in front of one rod and rotates the apparatus as the club is moved into a back swing. When the person stops, the apparatus rotates the rods 180 degrees so that the other rod makes contact with the front of the golf club. Then the person makes his foreswing while pushing the rod throughout the swing. Although the apparatus is less constraining than the device of the previously described patent, there is an artificial lag time at the top of the back swing and there would appear to be some safety problems with respect to the swinging rods, especially if the golf club were to slip off the rod or if the swinging rod made too fast an impact with the golf club as the person is at the top of his back swing.

It is clear that many exercising devices have been devised, some quite crude while others are more complex. None, however, allows for the elliptical type of two and/or three dimensional movements with accommodating resistance for training movements specific to athletic sports.

SUMMARY OF THE INVENTION

The present invention is directed to apparatus which when used with a fixed axis, fixed radius, speed limited, accomodating resistance system converts the system to a movable or variable radius, accomodating resistance system which allows for the elliptical type of two and/or three dimensional movements involved with training movements specific to athletic sports. The apparatus comprises a torque arm which is attachable at the axis of a torque resisting device, for the exercising person to exert force on the arm through rotatable connecting mechanism between the exercising person and the torque arm and through mechanism for traversing along the torque arm. The apparatus thereby allows for a fluctuating or variable radius exercise movement.

With reference to the outline discussed above, the present invention requires a whole new category of accomodating exercise on a par with, but different from, isometric and isokinetic exercise. The present apparatus with its fluctuating or variable radius provides for slight changes of speed as the radius varies, while movement may be in three dimensional space about a fixed axis. Furthermore, when the predetermined limiting speed of the apparatus is attained, an accomodating resistance is applied regardless of where the force is applied at any particular instant.

Thus, the apparatus allows for the elliptical type of two and three dimensional movement necessary for athletic sport and applies an accomodating resistance at speeds which a coach may select as being appropriate for the term, strength, etc. of the athlete. The present invention is indeed revolutionary with respect to athletic training, particularly training of an Olympic and professional caliber.

More specifically, the present invention is directed to an improvement of apparatus similar to that disclosed in U.S. Pat. No. 3,465,592. Therein isokinetic apparatus was disclosed for limiting the rotational speed of a shaft when rotated by an exercising person. The present invention converts such apparatus from being appropriate for isokinetic exercise to a type having a fluctuating radius which allows speed variation even though applied force may be constant. The present invention thus improves the apparatus and does so by providing structural features including a traversing and twistable or rotatable mechanism, such as a flexible strap or a roller bearing slide and a ball and socket swivel, which may slide along the torque arm. In addition, the torque arm includes arcuately shaped portions and possibly one section pivotable with respect to another. In this way, the exercising person may perform an athletic movement quite freely due to the design of the torque arm and the flexibility and sliding capability of the mechanism along the torque arm. Movement is hampered only by the counter resistance or limiting action of the countertorque apparatus. The present invention, therefore, stresses the exact muscles with accommodating resistance while the exercising person is doing the athletic movement he wishes to do in the form he wishes to do it.

In one embodiment, the present device provides for a flexible element between the torque arm and an extremity of the exercising person. One embodiment of the element includes a nylon loop for sliding along the torque arm connected by a flexible strap to a band or shoe or some other device for direct attachment or connection to the exercising person's arm or leg. In this way, the exercising person may move his upper body through the same motion as he would make while running the exercise upper body muscles used while running. By reattaching the flexible element to the foot or leg, while standing somewhat elevated on one leg, the other leg may be moved through the exact motion that the person would make while kicking or running thereby exercising the exact muscles used while doing the exact motion which would be used for performing those functions. Furthermore, the body extremity may be moved forward and backward, and accommodating resistance will be applied in both directions so as to exercise all muscles in both directions.

The present invention may also be used particularly advantageously with specific athletic instruments, such as, baseball bats, tennis rackets, racquetball rackets, hockey sticks, etc. That is, such instruments may be attached at the operational end to the flexible element. The exercising person then grasps the instrument by the handle in the usual way. Since the connecting element may slide along the torque arm and may twist in torsion, by appropriately orienting himself with respect to the axis of the resistance machine, the person may make the exact swing which he would otherwise make with the athletic instrument and may do so in forward and backswing directions. In each case, the various muscles of the body are exercised for the exact motion which is critical to the athlete for his particular sport.

Further advantage of the present invention is that the movement in either direction has to be initiated and maintained by the exercising person. No resistance is encountered until the lever arm has reached the predetermined speed. At that point the lever arm will move no faster and the exercising person will receive the accommodating resistance. Thus, a coach may watch an athlete in order to set a speed at which the athlete can maintain coordination and form. As the athlete increases in strength for the particular motion, the training speeds can be increased. The result of such an exercise program is that the athlete becomes stronger and faster with good form and coordination in performing the motions needed by the athlete for his/her particular sport.

These various objects and advantages of the present invention are described in more detail hereinafter with reference to a preferred embodiment as shown in the drawings briefly described as follows.

BRIEF DESCRIPTION OF THE DRAWINGS

FIGS. 4–6 illustrate schematically the motion for exercising the arm and upper body;

FIGS. 7–9 illustrate schematically the motion for exercising the leg and lower body;

FIGS. 14–15 illustrate schematically positions of a handball player at various points of a swing;

FIGS. 16–17 illustrate schematically various positions of a hockey player while taking a shot;

FIG. 18 is a perspective view of a person exercising with an alternate embodiment of the present invention;

FIG. 19 is a plan view of first and second sections of the torque arm of the alternate embodiment and the pivotal mechanism therebetween;

FIG. 25 is a plan, detail view of pivotal mechanism between first and second sections of the torque arm shown in FIGS. 23–24.

DETAILED DESCRIPTION OF THE PREFERRED AND OTHER EMBODIMENTS

Figure 1:
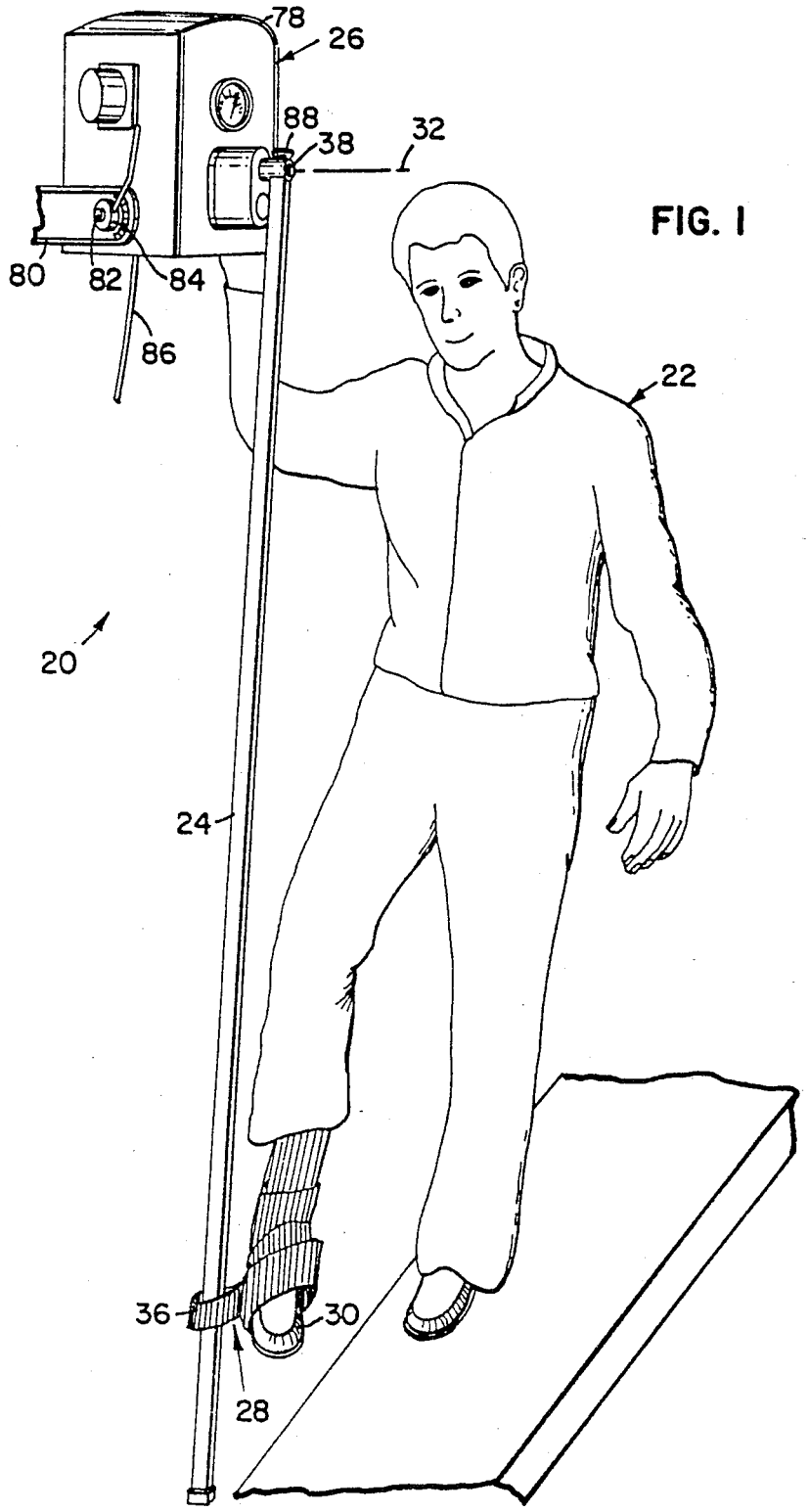
FIG. 1 is a perspective view of a person exercising with the apparatus of the present invention.

Referring now to the drawings wherein like numerals designate identical or corresponding parts throughout the several views, and more particularly to FIG. 1, apparatus in accordance with the preferred embodiment of the present invention is designated generally by the numeral 20. Apparatus 20 is being used by an exercising person 22. Apparatus 20 includes a torque arm 24 connected at one end to a machine 26 capable of applying a countertorque at a predetermined angular speed. At the other end a flexible strap 28 connects the foot 30 of person 22 slidably to torque arm 24. Torque arm 24 is forced by person 22 to rotate about axis 32. Machine 26 is preset to limit the speed of rotation of torque arm 24 when it reaches the predetermined value. Strap 28 is fixed to an extremity of person 22. In FIG. 1, strap 28 is shown fixed to foot 30 while in FIG. 3, strap 28 is shown fixed to the arm 34 of person 22. Strap 28 includes a loop 36 made of material which readily slides along arm 24.

The concept of the present exercising method is that the apparatus allows person 22 to make a particular athletic move using the form and coordination near the speed at which the move would ordinarily be made while at the same time providing with machine 26 a counter resistance which stresses and thereby strengthens the muscles used in that movement. As the muscles get stronger and stronger, the predetermined rotational speed at which resistance is applied may be increased so that person 22 gains speed and strength for the movement. Thus, the method of the present invention includes presetting the countertorque machine 26 so that a resistance force is applied to rotatable shaft 38 at a predetermined rotational speed. Flexible member 28 is connected between person 22 and torque arm 24. It is understood that torque arm 24 is attached nonparallel to shaft 38 and that flexible member 28 is slidable along torque arm 24. The person then moves torque arm 24 through flexible member 28 with a force which causes rotation of shaft 38 at the predetermined rotational speed. As indicated hereinbelow, resistance may be applied by machine 26 for both clockwise and counterclockwise rotations of shaft 38 so that all muscles for the complete athletic movement are exercised.

Resistance machine 26 may be of a type described in U.S. Pat. No. 3,465,592. Representative of such machines is the apparatus schematically illustrated in FIG. 2. Worm 40 is rotated by an electric motor 42 at a constant rotational velocity in the clockwise direction. A worm gear 44 is meshed with and driven counterclockwise by the worm 40 and is fixed to the upper element of an overrunning clutch 46. The worm 40 has a pitch such that the worm 40 can rotate worm gear 46, but worm gear 46 cannot rotate worm 40. Clutch 46 transmits torque from its outer element to its inner element in one direction only, and then only when the inner element is already being rotated in that direction at the same velocity that the outer element is rotating. Such a clutch 46 is conventional. The inner element of clutch 46 is fixed to a shaft 48 which is fixed to a gear 50.

A worm gear 52 is meshed with and driven clockwise by worm 40, and is fixed to the outer element of an overrunning clutch 54. Clutch 54 is smaller to clutch 46. The inner element of clutch 54 is fixed to shaft 56 which is fixed to gear 58. Gears 50 and 58 are each meshed with a third gear 60 which is fixed to shaft 38. Shaft 38 is driven by torque arm 24 as discussed hereinbefore and may be driven either clockwise or counterclockwise by the person exercising. In that regard, clutch 46 transmits torque only in the counterclockwise direction, while clutch 54 transmits torque only in the clockwise direction.

When the person exercising rotates shaft 38 below a threshold speed, neither of clutches 46 nor 54 engages to transmit torque, and the worm 40 is rotated by motor 42 without loading. When the person exercising rotates shaft 38 clockwise, shaft 48 is rotated counterclockwise and if done so at the threshold speed, clutch 46 engages to couple worm 40 through worm gear 44, clutch 46, shaft 48, gear 50 and gear 60 to shaft 38. Regardless of how much torque the person exercising applies to shaft 38, worm 40 will rotate at a constant speed thereby resisting, in effect, an aiding load. Similarly, when the person exercising rotates shaft 38 counterclockwise, shaft 56 is rotated and if it is rotated at the threshold speed, clutch 54 engages to couple worm 40 through worm gear 52, clutch 54, shaft 56, gear 58 and gear 60 to shaft 38.

Machine 26, once a clutch 46 or 54 has been engaged, is not capable of being accelerated by the person exercising, due to the unidirectional characteristic of motor 42 and the worm drive system. Any applied force tending to increase the torque to increase the threshold speed over which a clutch is engaged is opposed by a reaction force or countertorque from the gear system causing the system to oppose the applied overforce. When the applied force decreases below the threshold of clutch engagement, countertorque or resistance is no longer applied. At the threshold speed, however, machine 26 applies a kinetic resistance to the action of the person exercising, which is delicately responsive to the force which that person applies and is always slightly less than the force which he applies, from instant to instant.

Motor 42 is energized by an energy source 62. A switch 64 in series with motor 42 provides the possibility of an "isometric hold". A speed control or mechanism for adjusting the threshold speed at which countertorque is applied comprises an auto transformer or a potentiometer and a silicon control rectifier all of which are conventional and are represented by numeral 66. The adjusting mechanism may set threshold speeds in excess of 300 angular degrees per second.

A further feature which may be incorporated into the system includes a pair of magnetic clutches 68 and 70 interposed in series with shafts 48 and 56, respectively. The maximum torque which can be transmitted by clutch 68 is adjustably controlled by a rheostat 72 in series with clutch 68 and a source 74. The maximum torque which can be transmitted by clutch 70 is adjustably controlled by a rheostat 76 which is in series with clutch 70 and also with the source 74. These clutches 68 and 70 begin to slip at a given torque, and any force over such torque applied by the person exercising is dissipated in acceleration. Thus, clutches 68 and 70 may be used to provide some slight resistance to the rotation of shaft 38 as the rotational speed of shaft 38 increases to the threshold speed of clutch 46 or clutch 52.

Figure 2:
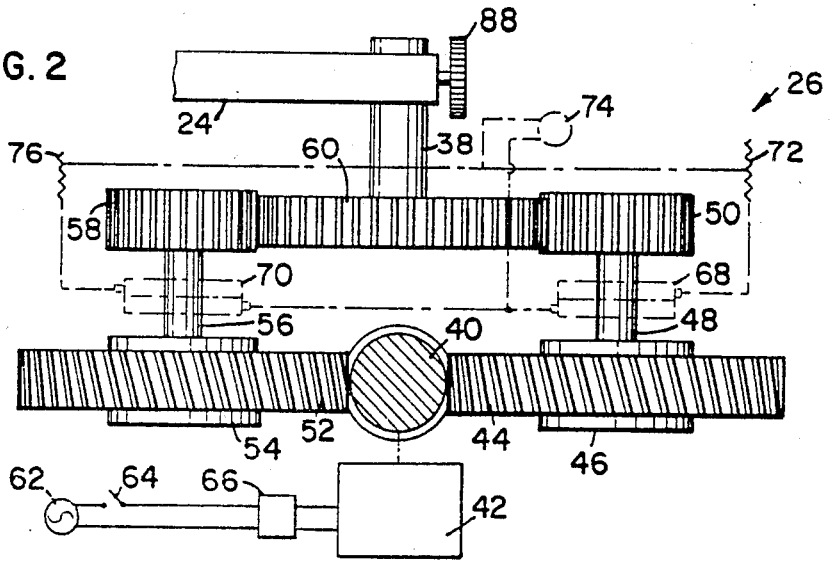
FIG. 2 is a schematic diagram of a prior art resistance device representative of the type which could be used in accordance with the present invention.

As shown in FIG. 1, apparatus like that described with respect to FIG. 2 is contained in housing 78. Housing 78 is held by a pair of arms 80 to a fixed framework (not shown). Housing 78 may be pivoted with respect to arms 80 at shaft 82 by loosening a threaded knob 84. Wiring cables 86 extend to control electronics 66 of the type described hereinbefore. Torque arm 24 is held fixed to shaft 38 with a set screw 88 having a knob, for example, thereon.

Figure 3:
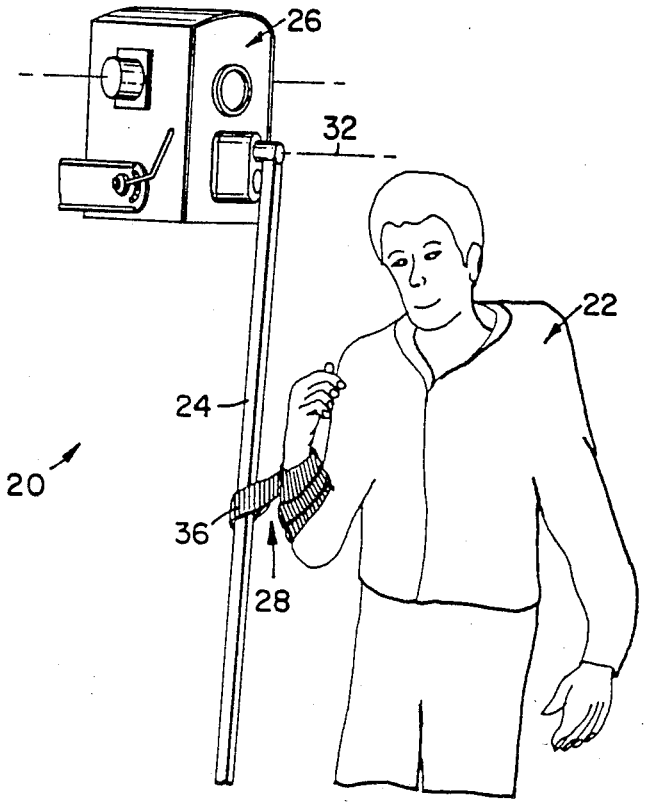
FIG. 3 is a perspective view similar to FIG. 1 showing the person exercising a different extremity.

Strap 28 provides the all-important connection between an extremity of exercising person 22 and torque arm 24. Strap 28 must be flexible so that it may be twisted or moved in rotation in a frame of reference having a pair of axes orthogonal to the torque arm. In addition, strap 28 must include a loop 36 which is slidable along torque arm 24. Thus, strap 28 provides complete movement freedom except for perpendicular translation away from torque arm 24. Strap 28 is sufficiently long that it may be wrapped about the foot or leg, for example, of person 22 and taped in place. Alternatively, strap 22 may include an elastic loop for slipping onto the arm of person 22 as shown in FIG. 3.

FIGS. 4–6 illustrate the type of movement made by a runner with his upper body. A runner needs good strength not only in the legs, but also throughout his body and particularly his upper body. FIG. 4 shows an exercising runner with his arm behind him; FIG. 5 shows the arm approximately even with his body; and FIG. 6 shows the arm in front of the exercising person. Reverse movement is similar going from FIG. 6 to FIG. 5 to FIG. 4. In all cases, the flexible strap allows various rotational positions with respect to torque arm 24 while loop 36 of strap 28 provides for sliding along torque arm 24. It is understood that the left arm may be exercised in a similar fashion.

FIGS. 7–9 provide a similar illustration of movements for exercising the leg, for example, for running or kicking or even perhaps swimming or other such sports.

Figure 10:
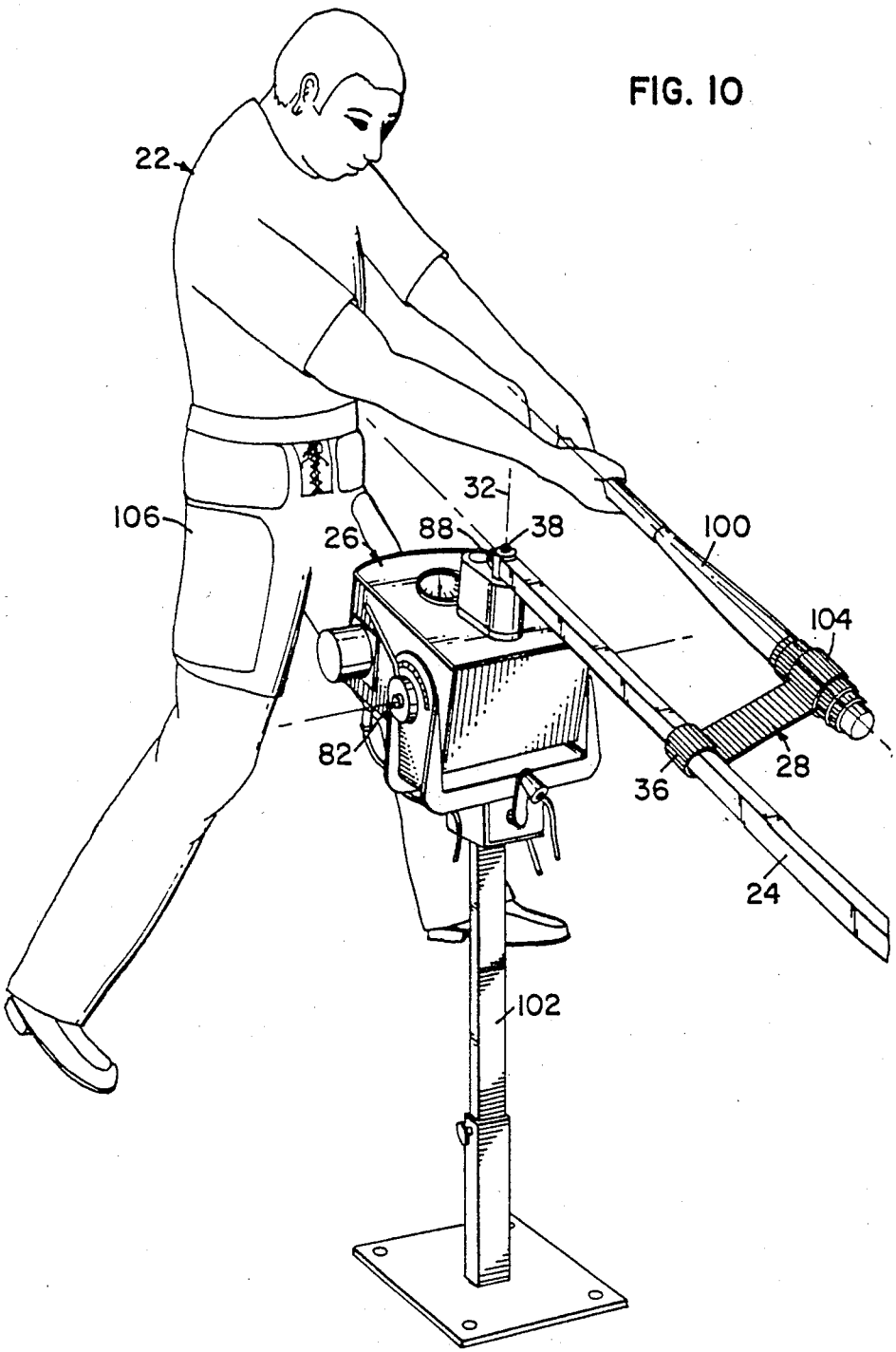
FIG. 10 is a perspective view of a person exercising with a bat and apparatus in accordance with the present invention.
Figure 11:
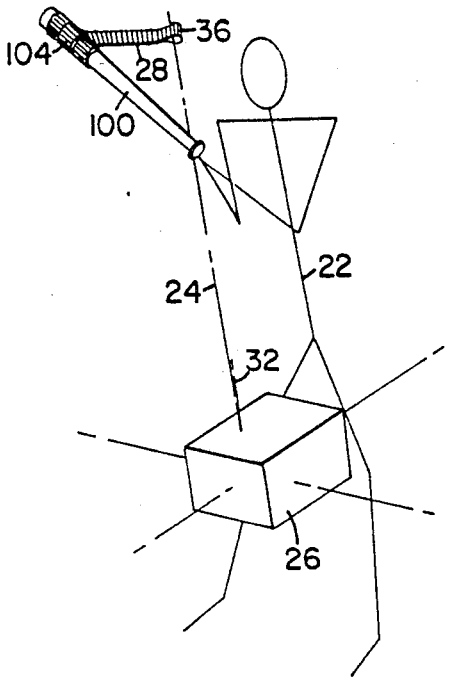
FIGS. 11–13 illustrate schematically positions of a batter at various points in a swing.
Figure 12:
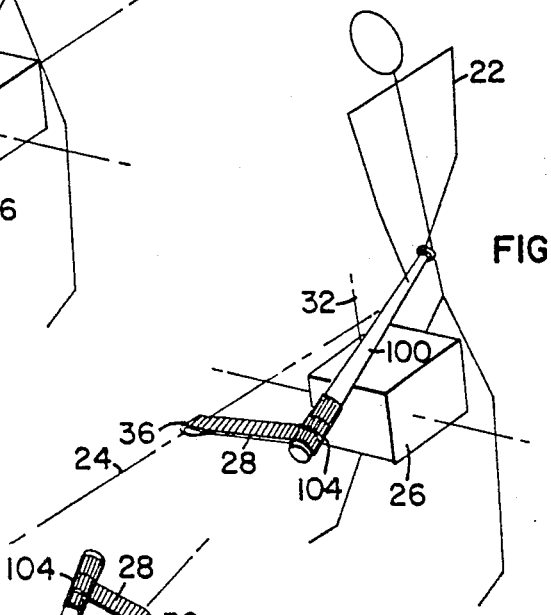
Figure 13:
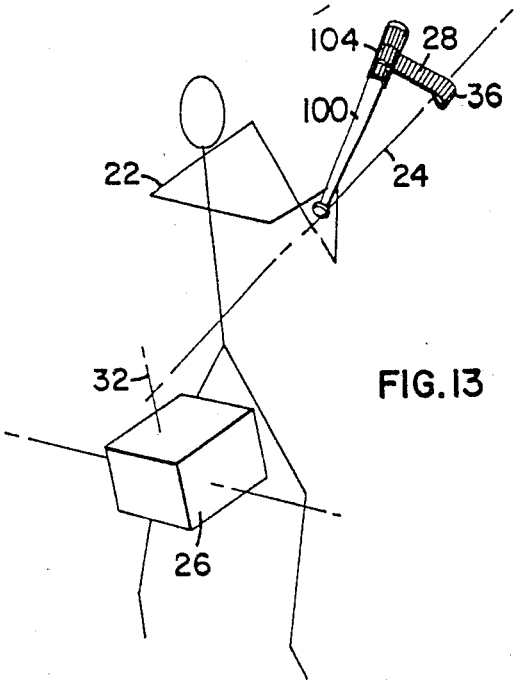

The concept of allowing strap 28 to slid along torque arm 24 so that an athlete may exercise an important movement at a speed where he can maintain form and coordination is a distinct breakthrough for athletic training. The concept takes on even more significance when it is understood that strap 28 may be attached to an athletic instrument such as baseball bat 100 shown in FIG. 10. That is, apparatus 20 may be used not only for direct connection to an extremity of an exercising person but may be used in conjunction with performing the movements and exercising the muscles for sports wherein an athletic instrument, such as, a baseball bat, a tennis racket, a handball racket, a hockey stick, etc., is used. As shown in FIG. 10, machine 26 is mounted on a stand 102 fixed to the floor. Machine 26 is placed at an appropriate height and oriented at shaft 82 so that shaft 38 and axis 32 are substantially vertical. Torque arm 24 then extends away from machine 26 at an orientation substantially horizontal with respect to the floor. Strap 28 includes loop 36 of a material, such as nylon, which easily slides along torque arm 24. The other end of strap 28 is fastened with, for example, tape 104 to the end of bat 100. The batter or exercising person 22 stands on the side of shaft 38 opposite torque arm 24. It is preferable for person 22 to wear some protection, such as hockey girdle 106, in the area of his hips so that torque arm 22 does not injure him as he swings from a complete backswing to a complete follow through. That is, the person may hold the bat by the handle in the usual fashion and pull the torque arm clockwise, for a right handed batter, to get in a position to swing (see also FIG. 11). As the person starts swinging counterclockwise the torque arm is accelerated in rotation (see FIGS. 10 and 12) until the predetermined speed of machine 26 is reached and a countertorque resistance is applied. Through the midrange, the person must work his muscles quite hard to try to maintain and increase the speed of his swing. As he goes into the follow through (see FIG. 13) the rotational speed decreases, likely below the threshold speed of machine 26, so that torque arm 24 may come around to strike the protection of girdle 106. Person 22 can then reverse the swing, for example in the sequence from FIG. 13 to FIG. 12 to FIG. 11, so as to exercise the appropriate muscles in both directions. Person 22 swings bat 100 about a virtual axis which moves but, on average, is in rough alignment with the axis 32 of shaft 38.

Similar use of apparatus 20 in conjunction with other athletic instruments is shown in FIGS. 14–17. In FIGS. 14–15, a movement common with a racket grasped with one hand, such as a handball racket, is illustrated. In FIGS. 16–17 a movement of a type used with an instrument, such as a hockey stick, wherein the instrument is grasped with two hands is shown. In each of these latter two cases, the axis of rotation of machine 26 is substantially horizontal, as opposed to the substantially vertical orientation with respect to a baseball hitter as shown in FIG. 10. The virtual axis, however, is roughly in alignment with shaft 38.

A number of alternate embodiments of the present invention are shown in FIGS. 18–25. Elements or parts equivalent to the preferred embodiment are identified by the same numerals, only the numerals are primed. In FIG. 18, apparatus 20' is used by person 22' for leg movements, such as for kicking, running, skating, etc. Apparatus 20' includes torque arm 24' connected to machine 26'. Machine 26' is mounted on an elevatable stand 102'. Machine 26' may be rotated with respect to stand 102' by loosening threaded nut 110 with lever 112 so that machine 26' may be turned about rod 114. Shaft 38' extends from machine 26' as described hereinbefore with respect to the preferred embodiment. Connecting elbow member 116 is attached to shaft 38' so that leg 118 extends at right angles to shaft 38'. Leg 118 is open and includes pin 120 for holding torque arm 24' to leg 118. As shown in more detail in FIG. 19, torque arm 24' includes first and second sections 122 and 124 held together by pivot mechanism 126. First and second sections 122 and 124 have at least opposite flat sides which mate with flat bars 128 forming a part of pivot mechanism 126. Bars 128 are fastened by a pair of nut and bolt combinations 130 and 132 on either side of first section 122. Bars 128 are pivotally fastened with nut, shoulder bolt and washer combination 134 to second section 124 so that the pivotal axis is orthogonal to the axis of shaft 38'. First and second sections 122 and 124 are slightly spaced at adjacent ends so that second section 124 may pivot at 134 without interferring with first section 122. A U-shaped member 136 is fastened with bolts 138, one of which is shown in FIG. 19, to the outermost ends of bars 128 and functions to limit the pivot angle of second section 124 in a direction toward stand 102'.

Person 22' is shown in FIG. 18 wearing a sole 142 with a plurality of straps 144 holding the sole to the person's foot. A loop 146 of flexible material is attached about half way between the toe and heel of sole 142 and fits about second section 124 of torque arm 24'. In addition, a loop 148, similar to loop 146, is attached to the toe of sole 142.

In use, the rotation limiting mechanism of machine 26' is preset for a predetermined rotational speed. Torque arm 24' is fastened to leg 118 by inserting pin 120 into an opening 150 in first section 122 of torque arm 24'. Sole 142 is then strapped onto the foot of person 22' and one of loops 146 or 148 is placed about second section 124 of torque arm 24'. Person 22' then performs a particular athletic exercise. The exercise may simulate very closely a movement which would actually be made in a particular sport since as the person moves his leg, loop 146 may translate along second section 124, while torque arm 24' may pivot about an axis orthogonal to the rotation which torque arm 24' turns shaft 38'. Thus, for example, person 22' may push outwardly and backwardly in the form of a skater or may swing his leg in an arc more closely aligned with the direction he is facing for the movement of a kicker, or he may place loop 148 about second section 124 and exercise groin muscles specifically.

In a second alternate embodiment, apparatus 20'' is used by person 22'' to exercise muscles related to the movement of swinging a bat 100''. Again, machine 26'' is mounted on a stand 102'', and machine 26'' may be inclined with respect to stand 102'' by loosening nut 110''. Machine 26'' is oriented so that the axis of rotational shaft 38'' is directed generally vertically. A connecting member 152 has a tubular portion 154 at one end which fits about shaft 38'' and is held on shaft 38'' by a cap nut 156. A short length of square tube 158 extends approximately horizontally outwardly from cylindrical portion 154. Torque arm 24'' is preferably square in cross section and arcuately shaped from one end to the other. End 160 of torque arm 24'' fits in connecting member 158 and is held in place with pin 120''. The square cross section of torque arm 24'' is slightly less than the internal square cross section of connecting member 158 so that end 160 is snugly received and held tightly in place by pin 120'' inserted in one of the appropriate openings.

Figure 20:
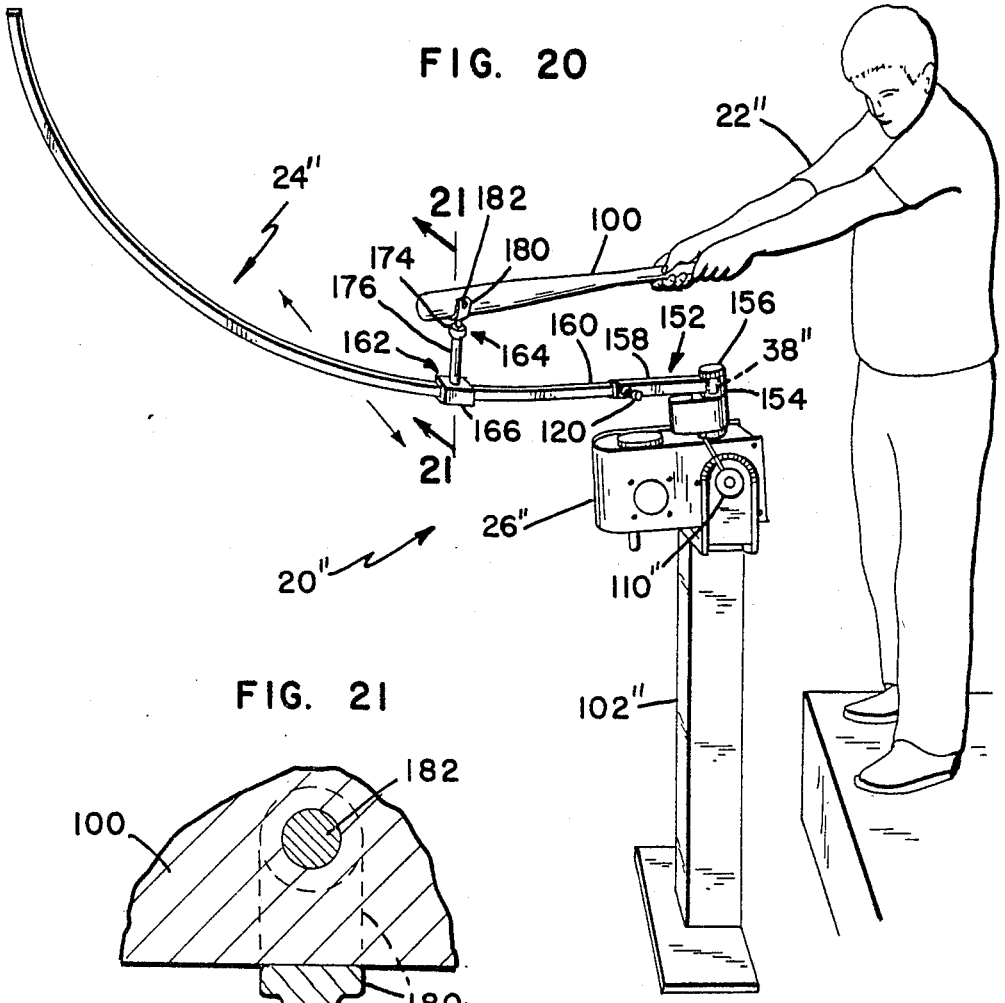
FIG. 20 is a perspective view of a person exercising with a second alternate embodiment of apparatus in accordance with the present invention.
Figure 21:
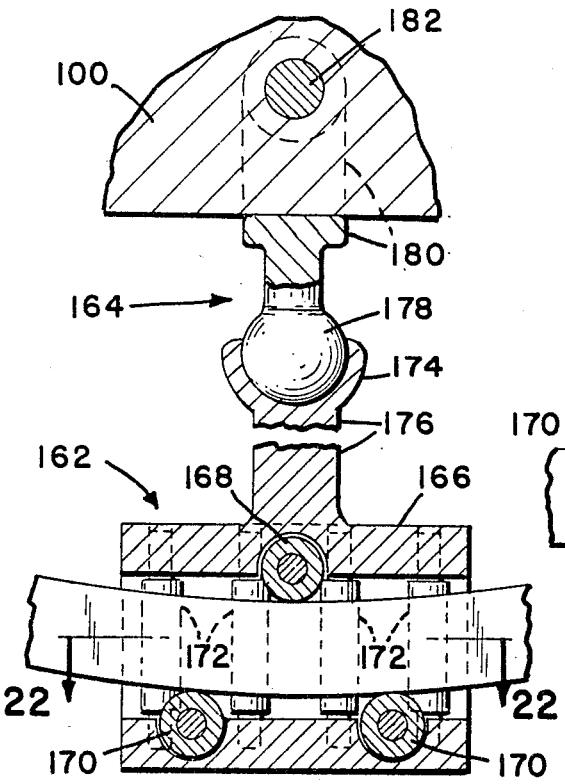
FIG. 21 is a cross-sectional view, taken along line 21—21 of FIG. 20.
Figure 22:
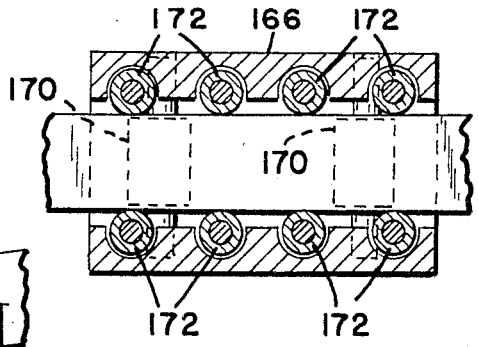
FIG. 22 is a cross-sectional view taken along line 22—22 of FIG. 21.

Bat 100'' is connected to torque member 24'' by a traversing mechanism 162 and a rotating mechanism 164 as shown in FIGS. 20–22. Traversing mechanism 162 may have solid bearing surfaces shaped to slide on arcuate torque arm 24''. It is preferable, however, to use a housing 166 with a plurality of roller bearings as described hereinafter. A single cylindrical roller 168 is centrally located in housing 166 to follow along the inner circumference of arcuate torque arm 24''. A pair of spaced apart rollers 170 separated from roller 168 sufficiently to receive torque arm 24'' therebetween, roll along the outer circumference of torque arm 24''. A plurality of spaced rollers 172 roll along each of the vertical sides of torque arm 24''. The rollers are formed as cylinders with small shafts received in mating cavities in housing 166.

Rotating mechanism 164 may be a twistable, flexible strap as described hereinbefore, or, as shown in FIG. 21, may be a ball and socket mechanism 164. Mechanism 164 includes a socket member 174 attached at a stem 176 to housing 166. Ball 178 is attached at a yoke 180 with a nut and bolt combination 182 to bat 100''.

In use, machine 26'' is oriented so that shaft 38'' is generally vertical. The speed limiting mechanism of machine 26'' is preset to a predetermined rotational speed. Torque arm 24'' is attached to connecting member 158 by inserting end 160 in member 158 and installing pin 120'' in appropriate passages to hold the two members together. Torque arm 24'' is implaced to curve upwardly from an approximately horizontal intersection with shaft 38''.

Since the barrel of bat 100'' is connected to rotating mechanism 164 and traversing mechanism 162, person 22'' holds the handle of bat 100'' while standing on a side of shaft 38'' opposite bat 100''. Person 22'' swings bat 100'' in a coordinated bat-swinging motion so that near the higher speed of the swing, the rotational motion of torque arm 24'' is limited by machine 26''. Person 22'' may swing bat 100'' in either direction so as to exercise muscles in both directions.

Figure 23:
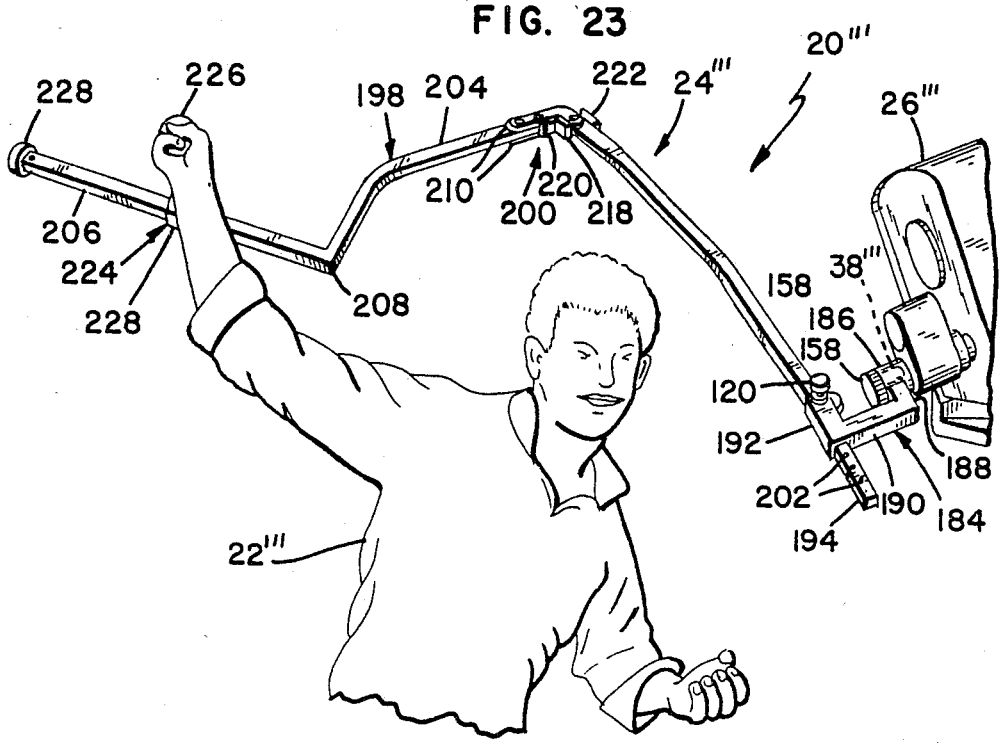
FIG. 23 is a perspective view of a person exercising with a third embodiment of apparatus in accordance with the present invention.
Figure 24:
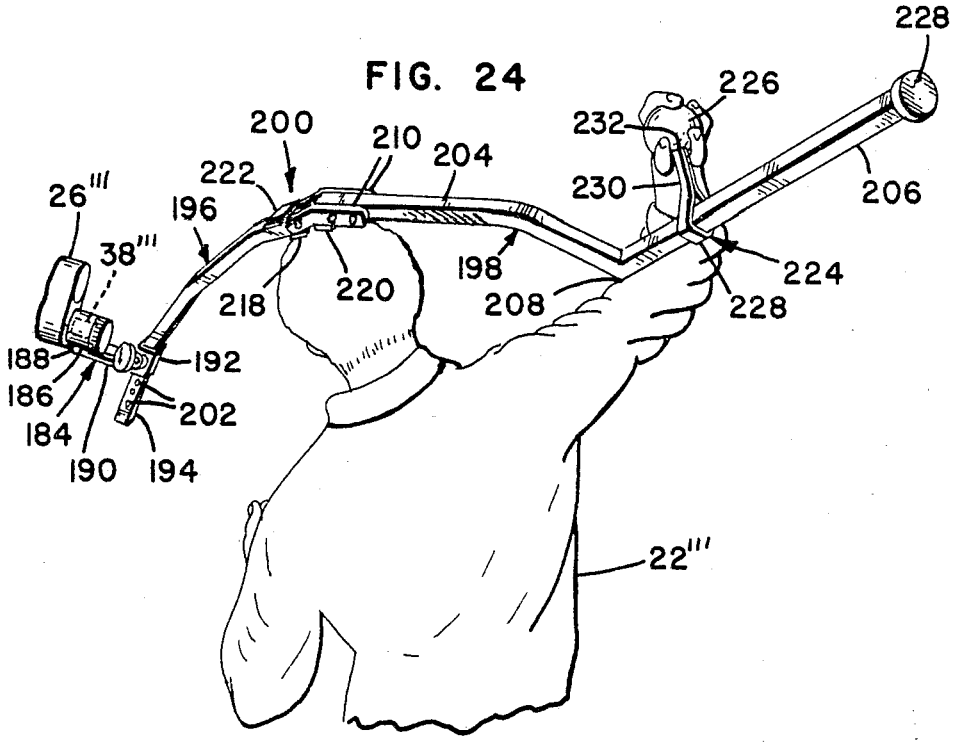
FIG. 24 is a view from the opposite side of the apparatus shown in FIG. 23.

In a third alternate embodiment, as shown in FIGS. 23–25, apparatus 20''' may be used to strengthen the particularly vulnerable rotater cuff muscle, as well as other throwing muscles, used by ball throwers, especially baseball pitchers. Machine 26''' is oriented so that shaft 38''' is directed generally toward person 22'''. Torque arm 24''' is attached to connecting member 184 which is attached to shaft 38'''. Connecting member 184 is made of square tubing formed in a U-shape. A cylindrical tube portion 186 is attached at the end of one leg 188. Cylindrical portion 186 is oriented so that its axis is parallel with base 190 of member 184. The other leg 192 of member 194 is hollow with an opening in base 190 so that end 194 of torque arm 24''' may pass through leg 192. A cap screw 158''' holds connect member 184 onto shaft 38'''.

Torque arm 24''' includes first and second sections 196 and 198 held together at pivoting mechanism 200. Both first and second sections 196 and 198 include arcuate portions. First section 196 has an end 194 with a square crosssection slightly smaller than the internal square cross-section of leg 192 so that first section 196 fits snugly therein. End 194 further includes a plurality of passages 202 so that pin 120''' may be fitted through passages in leg 192 and one of the passages 202 to hold first section 196 with respect to leg 192. Leg 192 is orthogonal to the axis of shaft 38'''. Thus, first section 196 extends generally upwardly. First section 196 is bent or arcuately shaped to curve at least partially over person 22'''. Second section 198 includes a bent or arcuate portion 204 which is connected to first portion 196 at pivot mechanism 200. A straight portion 206 extends somewhat upwardly with respect to the horizontal from attachment to arcuate portion 204 at corner 208. In combination, the arcuate portions of first and second sections 196 and 198 curve generally over person 22'''. Portion 206 of second section 198 remains inclined with respect to the axis of shaft 38''' and, consequently, torque arm 24''' may be functioned to rotate shaft 38'''.

Pivot mechanism 200 is shown most clearly in FIG. 25. Pivot mechanism 200 includes a pair of flat bars 210 attached on opposite sides of second section 198 with nut and bolt combinations 212 and 214. First section 196 is pivotally attached to bars 210 by nut and shoulder bolt combination 216. Bars 210 may be shaped so as to make a V-shaped angle at approximately the intersection of first and second sections 196 and 198 as shown in FIG. 25. Preferably, a stop 218 and 220 is fastened to each of first and second sections 196 and 198, respectively, at the ends thereof to prevent second section 198 from pivoting too far toward person 22''' with respect to first section 196. In addition, a third stop 222 may be fastened to the top or opposite side of first section 196 in order to limit upward pivoting movement of second section 198 with respect to first section 196.

In use, connect member 184 is attached to shaft 38''', and torque arm 24''' is attached to connect member 184. The rotation limiting mechanism of machine 26''' is set for a predetermined rotational speed. A traversing mechanism 224 attached to ball 226 is slid onto straight portion 206 of second section 198. A stop 228 is fastened to the end of portion 206 to prevent traversing mechanism 224 from inadvertently sliding off. Person 22''' grasps ball 226 and moves torque arm 24''' so as to rotate shaft 38''' at the preset rotational speed. At the same time, ball 226 is moved so that traversing mechanism 224 slides along straight portion 206 as required.

It is noted that traversing mechanism 224 as shown in FIGS. 23 and 24 includes a loop 230 with a connecting link 232 to a fastening mechanism 234 which attaches connecting mechanism 224 to ball 226. Loop 224 and connecting link 230 are preferably made from a flexible material, such as nylon.

Thus, apparatus 20 of the present invention may be embodied in a number of forms and may not only be used in direct connection with the person, but may be used by a person to exercise movements with athletic instruments applicable to particular sports. As exemplified by the many embodiments, it is understood that the torque arm, connecting mechanism between the torque arm and the rotatable shaft, as well as the traversing and rotating mechanisms attached directly to a person or attached to an athletic instrument, may be shaped and formed in a number of designs and comprised of more or less elements. Thus, even though the advantages and details of structure and function of the present exercising machine and method have been set forth in detail, they must be considered exemplary. It is understood, therefore, that changes made, especially in matters of shape, size, arrangement and combinations of components and assemblies, to the full extent extended by the general meaning of the terms in which the appended claims are expressed, are within the principle of the invention.

What is claimed is:

1. An exercise apparatus for a person, comprising:

a shaft rotatable about a first axis;

means for resisting at a predetermined rotational speed the rotation of said shaft;

a torque arm;

first means for connecting said torque arm to said shaft such that said torque arm is nonparallel to said first axis;

means for traversing along said torque arm, said traversing means including a housing and means attached to said housing for bearing against said torque arm, said bearing means including a plurality of rollers; and second means for connecting said traversing means to said person, said second connecting means including means for rotating with respect to said torque arm.

2. An apparatus for isokinetically exercising muscles of a person, said apparatus comprising:

a shaft rotatable about a first axis;

means for adjustably limiting the rotational speed of said shaft to a preset value;

an arm for applying a torque to rotate said shaft, said torque arm including first and second sections and means for pivoting said second section with respect to said first section about a second axis orthogonal to said first axis;

first means for connecting said torque arm to said shaft;

an athletic instrument useable in a swinging motion; and second means for connecting said athletic instrument to said torque arm, said second connecting means including means for positioning said athletic instrument for rough alignment of a virtual axis of rotation of said instrument with the first axis of said shaft when said instrument is swung by said person.

3. An apparatus in accordance with claim 2 wherein said torque arm includes an upwardly-turned, arcuate portion along which said traversing means may move.

4. An apparatus for isokinetically exercising muscles of a person, said apparatus comprising:

a shaft rotatable about a first axis directed generally toward said exercising person;

means for adjustably limiting the rotational speed of said shaft to a preset value;

an arm for applying torque to rotate said shaft, said arm including first and second sections and means for pivoting said second section with respect to said first section, said first and second sections each having arcuate portions so that said torque arm curves generally over said exercising person, said second section having also an end portion; said pivoting means being located between said arcuate portions generally above said exercising person, said end portion being inclined with respect to said first axis;

means for attaching said arm to said shaft;

means for traversing along said end portion of said torque arm;

a ball;

means for connecting said ball to said traversing means, said connecting means including means for rotating said ball with respect to said traversing means;

whereby said exercising person may isokinetically exercise the motion of throwing said ball by standing generally under said torque arm, grasping said ball and making a throwing motion at the preset rotational speed.

5. An exercise apparatus for a person comprising:

a rotatable shaft;

a housing for supporting said shaft, said housing containing means for adjustably limiting the rotational speed of said shaft to a preset value;

a torque arm for rotating said shaft, said torque arm including first and second sections, said first section being connected to said shaft, said torque arm further including means for pivoting said second section with respect to said first section about an axis orthogonal to said shaft, said first and second sections of said torque arm each including opposing sides with flat portions, said pivoting means including a pair of connect members having flat sides for mating with the flat portions of said first and second sections, said pivoting means further including means for attaching said connect members to said first section and means for pivotably attaching said connect members to said second section, said pivotal attaching means having an axis orthogonal to said shaft;

means for traversing along the second section of said torque arm; and means, attached to said traversing means, for contacting said person, whereby said person may apply exercising force through said contacting means and traversing means to said torque arm to rotate said shaft to said preset value.

6. An apparatus in accordance with claim 5 wherein said first and second portions of said torque arm include first and second arcuate portions, respectively.

7. An apparatus in accordance with claim 5 including means for stopping said traversing means near an unattached end of said second section of said torque arm to prevent said traversing means from falling off said second section.

8. An apparatus in accordance with claim 5 wherein said pivoting means still further includes means for stopping pivoted movement in at least one direction.

* * * * *